US011211726B2

(12) United States Patent
Komoto et al.

(10) Patent No.: US 11,211,726 B2
(45) Date of Patent: Dec. 28, 2021

(54) CONNECTOR AND CONNECTING METHOD

(71) Applicant: Japan Aviation Electronics Industry, Limited, Tokyo (JP)

(72) Inventors: Tetsuya Komoto, Tokyo (JP); Seiya Matsuo, Tokyo (JP); Osamu Hashiguchi, Tokyo (JP); Akira Kimura, Tokyo (JP); Akihiro Matsunaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/930,826

(22) Filed: Jul. 16, 2020

(65) Prior Publication Data

US 2021/0057838 A1 Feb. 25, 2021

(30) Foreign Application Priority Data

Aug. 23, 2019 (JP) ..... JP2019-152531

(51) Int. Cl.
*H01R 12/77* (2011.01)
*H01R 13/10* (2006.01)

(52) U.S. Cl.
CPC ..... *H01R 12/778* (2013.01); *H01R 12/771* (2013.01); *H01R 12/777* (2013.01); *H01R 13/10* (2013.01)

(58) Field of Classification Search
CPC ..... H01R 4/5083
See application file for complete search history.

(56) References Cited

U.S. PATENT DOCUMENTS 3,696,319 A * 10/1972 Olsson ..... H01R 12/78 439/496
6,012,940 A 1/2000 Wheeler
2007/0037434 A1 2/2007 Fedder et al.
2018/0233854 A1 8/2018 Komoto et al.

FOREIGN PATENT DOCUMENTS

EP 3494820 A1 6/2019
JP 2018129244 A 8/2018

OTHER PUBLICATIONS

Office Action dated Nov. 1, 2021 in CN Application No. 202010583931.4, 11 pages.

* cited by examiner

*Primary Examiner* — Ross N Gushi
(74) *Attorney, Agent, or Firm* — Muncy, Geissler, Olds and Lowe, P.C.

(57) ABSTRACT

A connector includes a pushing member having a projection, and a contact having a projection accommodating portion of a recess shape, the projection includes a holding portion extending across the projection in a direction orthogonal to a projecting direction of the projection and holding a flexible conductor, when the projection is inserted into the projection accommodating portion of the contact together with the flexible conductor with a middle part of the flexible conductor being held by the holding portion of the projection, parts of the flexible conductor that are situated on opposite sides of and are adjoining the middle part of the flexible conductor are sandwiched between a lateral surface of the projection and an inner surface of the projection accommodating portion to contact the inner surface of the projection accommodating portion, whereby the contact is electrically connected to the flexible conductor.

23 Claims, 9 Drawing Sheets

CONNECTOR AND CONNECTING METHOD

BACKGROUND OF THE INVENTION

The present invention relates to a connector and a connecting method, particularly to a connector connected to a flexible conductor.

As the connector connected to a flexible conductor, for example, JP2018-129244A discloses a connector as illustrated in FIG. 25. This connector includes a contact 2 and a base member 3 that are disposed on the opposite sides across a flexible substrate 1 to sandwich the flexible substrate 1 therebetween.

A flexible conductor 4 is exposed on the flexible substrate 1 on the side facing the contact 2, the contact 2 has a projection accommodating portion 5 of a recess shape formed to face the flexible conductor 4, and a projection 6 is formed on the base member 3 to project toward the bottom of the flexible substrate 1. When the projection 6 of the base member 3 is, together with the flexible substrate 1, inserted into the projection accommodating portion 5 of the contact 2 with the flexible substrate 1 being sandwiched between the projection 6 and the contact 2 such that the projection 6 is covered by the flexible substrate 1, the flexible substrate 1 is pressed against the inner surface of the projection accommodating portion 5 of the contact 2 by the projection 6, and the inner surface of the projection accommodating portion 5 makes contact with the flexible conductor 4 exposed on the surface of the flexible substrate 1 accordingly, whereby the contact 2 is electrically connected to the flexible conductor 4.

Meanwhile, when the projection 6 of the base member 3 together with the flexible substrate 1 is inserted into the projection accommodating portion 5 of the contact 2, the flexible substrate 1 readily moves relative to the projection 6, causing a problem that the connection process for connecting the connector comprising the contact 2 and the base member 3 to the flexible substrate 1 becomes difficult.

In particular, when the flexible substrate 1 has a width narrower than that of the projection 6, the projection 6 and the flexible substrate 1 need to be inserted into the projection accommodating portion 5 of the contact 2 while their relative position where the flexible substrate 1 extends across a top of the projection 6 is maintained, which makes the connection process for connecting the connector to the flexible substrate 1 more difficult. In addition, if the flexible substrate 1 moves off from the position relative to the projection 6, reliability of electrical connection between the flexible conductor 4 and the contact 2 may be impaired.

SUMMARY OF THE INVENTION

The present invention has been made to solve the foregoing problems and aims at providing a connector that can be readily connected to a flexible conductor and can ensure the reliability of electrical connection to the flexible conductor.

The present invention also aims at providing a connecting method for electrically connecting a contact to a flexible conductor with ease.

A connector according to the present invention is a connector to be connected to a flexible conductor, the connector comprising:

a pushing member having a projection; and a contact made of a conductive material and having a projection accommodating portion of a recess shape into which the projection is inserted, wherein the projection includes a holding portion extending across the projection in a direction orthogonal to a projecting direction of the projection and holding the flexible conductor, and wherein, when the projection is inserted into the projection accommodating portion of the contact together with the flexible conductor with a middle part of the flexible conductor being held by the holding portion of the projection, parts of the flexible conductor that are situated on opposite sides of and are adjoining the middle part of the flexible conductor are sandwiched between a lateral surface of the projection and an inner surface of the projection accommodating portion to contact the inner surface of the projection accommodating portion, whereby the contact is electrically connected to the flexible conductor.

A connecting method according to the present invention is a connecting method for connecting a contact to a flexible conductor, the method comprising:

holding a middle part of the flexible conductor by a holding portion extending across a projection of a pushing member in a direction orthogonal to a projecting direction of the projection; and inserting the projection into a projection accommodating portion of a recess shape of the contact together with the flexible conductor, whereby parts of the flexible conductor that are situated on opposite sides of and are adjoining the middle part of the flexible conductor are sandwiched between a lateral surface of the projection and an inner surface of the projection accommodating portion to contact the inner surface of the projection accommodating portion, whereby the contact is electrically connected to the flexible conductor.

DETAILED DESCRIPTION OF THE INVENTION

Embodiments of the present invention are described below with reference to the accompanying drawings.

Embodiment 1

Figure 1:
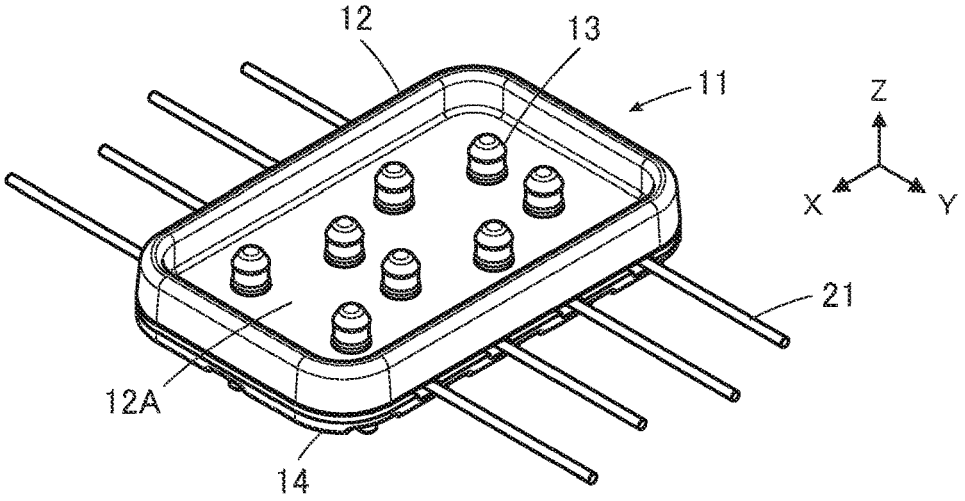
FIG. 1 is a perspective view showing a connector according to Embodiment 1 of the present invention.

FIG. 1 illustrates a connector 11 according to Embodiment 1. The connector 11 is used as, for example, a garment-side connector portion for fitting a wearable device and is connected to a plurality of flexible conductors 21.

The connector 11 includes a housing 12, a plurality of contacts 13 and a base member 14 that faces the housing 12 with a plurality of flexible conductors 21 being sandwiched therebetween, and the plurality of contacts 13 are electrically connected to the plurality of flexible conductors 21 in a one-by-one manner. The housing 12 includes a recess 12A, and in the recess 12A of the housing 12, the contacts 13 project perpendicularly from a flat bottom surface of the recess 12A.

The flexible conductors 21 are produced using a conductive yarn formed by twisting a plurality of conductive fibers.

For convenience, the bottom surface of the recess 12A of the housing 12 is defined as extending along an XY plane, and the direction in which the contacts 13 project is referred to as "+Z direction."

As the contacts 13, provided are four pairs of contacts 13 arranged in the X direction, and two contacts 13 in each pair are aligned in the Y direction.

Figure 2:
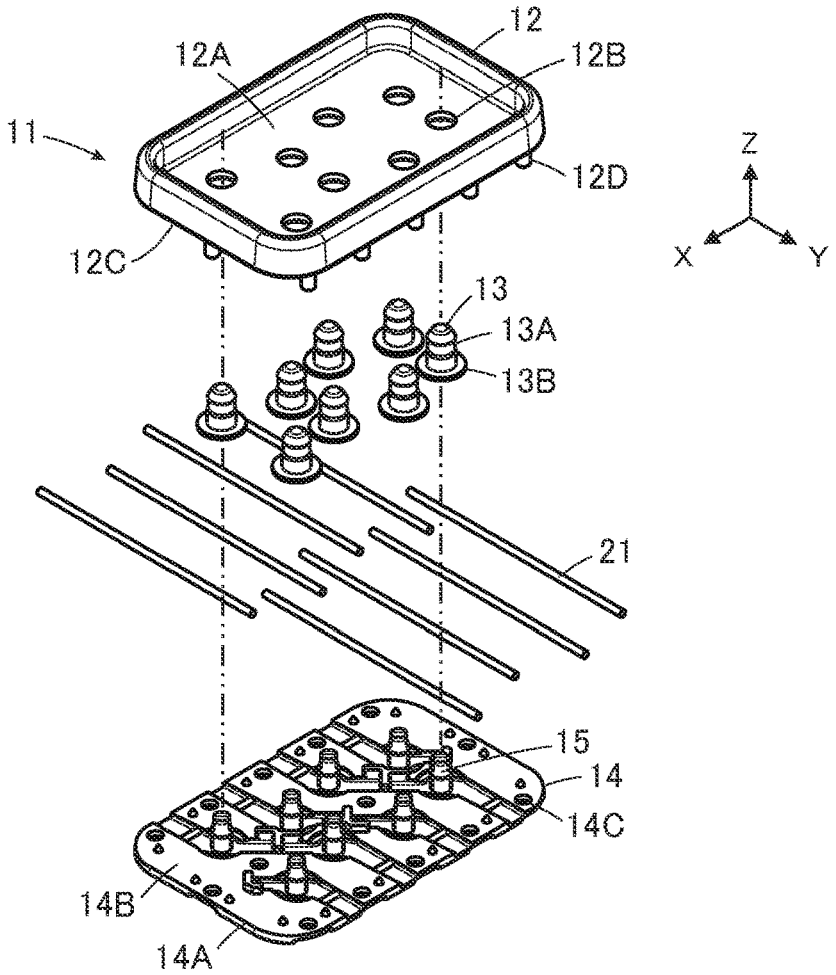
FIG. 2 is an exploded perspective view of the connector according to Embodiment 1.

As illustrated in FIG. 2, the housing 12 is made of an insulating material such as an insulating resin, and a plurality of contact through-holes 12B are formed in the recess 12A opening in the +Z direction. The recess 12A constitutes a counter-connector accommodating portion, in which a part of a counter connector (not shown) is to be accommodated. The contact through-holes 12B separately correspond to the contacts 13. On a rear surface 12C on the −Z direction side of the housing 12, a plurality of bosses 12D are formed to project in the −Z direction.

The contacts 13 are plug-type contacts made of a conductive material such as metal, and are to be connected to corresponding contacts of a counter connector (not shown) when a part of the counter connector is accommodated in the recess 12A of the housing 12. Each contact 13 has a tubular portion 13A of a cylindrical shape extending in the Z direction and a contact-side flange 13B extending from the −Z directional end of the tubular portion 13A along an XY plane.

The base member 14 constitutes a pushing member, is made of an insulating material such as an insulating resin and includes a flat plate portion 14A. The flat plate portion 14A includes a front surface 14B facing in the +Z direction so as to face the rear surface 12C on the −Z direction side of the housing 12, and a plurality of projections 15 are formed on the front surface 14B to project therefrom. The projections 15 separately correspond to the contacts 13. Four pairs of projections 15 are arranged in the X direction, and two projections 15 in each pair are aligned in the Y direction.

In addition, a plurality of boss accommodating holes 14C corresponding to the bosses 12D of the housing 12 are formed in the flat plate portion 14A.

The contact through-holes 12B of the housing 12, the contacts 13, the flexible conductors 21 and the projections 15 of the base member 14 are arranged so as to positionally align with each other in the Z direction.

Similarly, the bosses 12D of the housing 12 and the boss accommodating holes 14C of the base member 14 are arranged so as to positionally align with each other in the Z direction.

The contact through-holes 12B of the housing 12 have an inside diameter larger than the outside diameter of the tubular portions 13A of the contacts 13 and smaller than the outside diameter of the contact-side flanges 13B, thus allowing smooth insertion of the tubular portions 13A of the contacts 13.

Further, the boss accommodating holes 14C of the base member 14 have an inside diameter equal to or slightly smaller than the outside diameter of the bosses 12D of the housing 12, and by press-fitting the bosses 12D into the boss accommodating holes 14C, the housing 12 and the base member 14 are fixed to each other.

Figure 3:
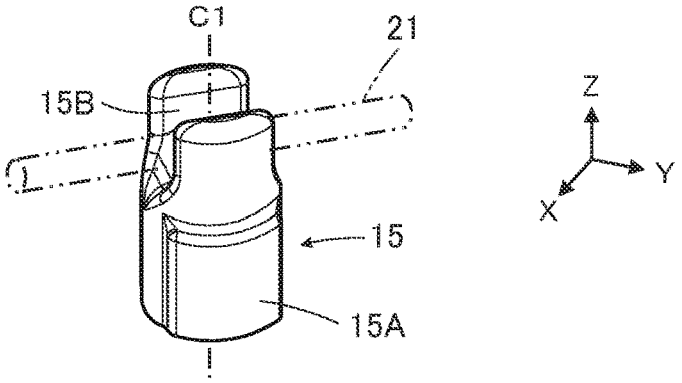
FIG. 3 is a perspective view showing a projection used in the connector according to Embodiment 1.

As illustrated in FIG. 3, each of the projections 15 of the base member 14 has a projection body 15A in the shape of a substantially cylindrical column projecting in the +Z direction along a central axis Cl. The +Z directional tip of the projection body 15A is divided into halves across the central axis Cl. Accordingly, the projection 15 is provided at the +Z directional tip thereof with a holding groove 15B that opens in the projecting direction of the projection 15 and extends across the projection 15.

The holding groove 15B forms a holding portion for holding a middle part of the flexible conductor 21 made of a conductive yarn and has a width dimension larger than the diameter dimension of the flexible conductor 21, so that the flexible conductor 21 can be smoothly inserted into the holding groove 15B from the +Z direction side.

Figure 4:
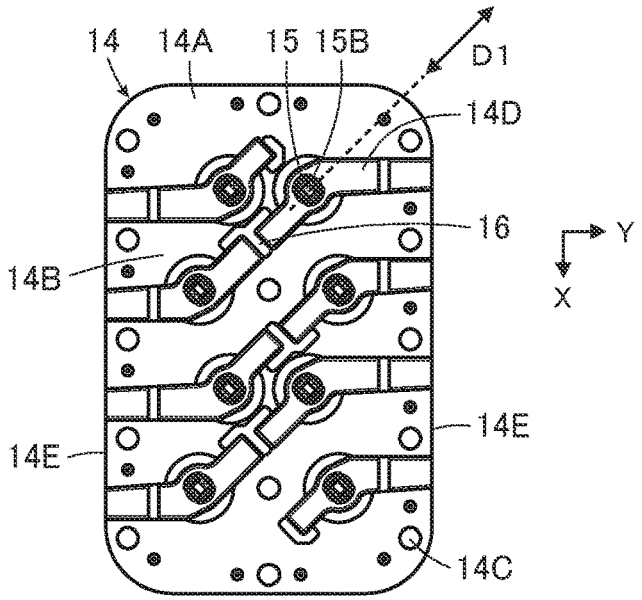
FIG. 4 is a plan view showing a base member used in the connector according to Embodiment 1.

As illustrated in FIG. 4, the projections 15 formed on the flat plate portion 14A of the base member 14 to project therefrom are arranged such that the plurality of holding grooves 15B extend in a same direction. Specifically, the holding grooves 15B of the projections 15 each extend in an inclined direction D1 that is inclined by 45 degrees with respect to the X direction and the Y direction.

The flat plate portion 14A is provided with flexible conductor accommodating grooves 14D separately corresponding to the projections 15, a pair of which flexible conductor accommodating grooves 14D are disposed on opposite sides across each projection 15. The flexible conductor accommodating grooves 14D are used to accommodate the flexible conductors 21 that are electrically connected to the corresponding contacts 13.

The pair of flexible conductor accommodating grooves 14D disposed on opposite sides of each projection 15 separately extend in directions intersecting each other. Specifically, while the flat plate portion 14A has a pair of side edges 14E positioned at opposite ends in the Y direction, with respect to the projection 15, the flexible conductor accommodating groove 14D disposed on the side closer to one of the side edges 14E extends in the Y direction and reaches the closer side edge 14E. On the other hand, the other flexible conductor accommodating groove 14D disposed on the opposite side of the closer side edge 14E across the projection 15 extends in the inclined direction D1.

Among the plurality of projections 15, between a pair of projections 15 arranged in the inclined direction D1 side by side, the flexible conductor accommodating grooves 14D disposed and corresponding to the pair of projections 15 are situated on a single line along the inclined direction D1, and between these flexible conductor accommodating grooves 14D, a partition wall 16 is formed and projects in the +Z direction from the flat plate portion 14A.

Figure 5:
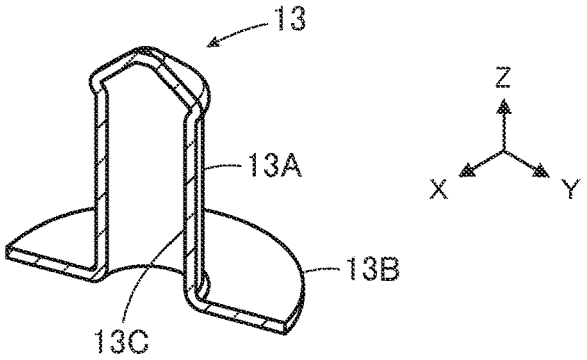
FIG. 5 is a perspective cross-sectional view showing a contact used in the connector according to Embodiment 1.

As illustrated in FIG. 5, the tubular portion 13A of the contact 13 has a cylindrical shape with the +Z directional end thereof being closed, the contact-side flange 13B is formed integrally with the −Z directional end of the tubular portion 13A, and a projection accommodating portion 13C of a recess shape is formed in the tubular portion 13A. More specifically, the contact-side flange 13B is formed so as to surround an opening end of the projection accommodating portion 13C.

The contact 13 as above can be manufactured by, for example, press working, cutting or cold heading.

Figure 6:
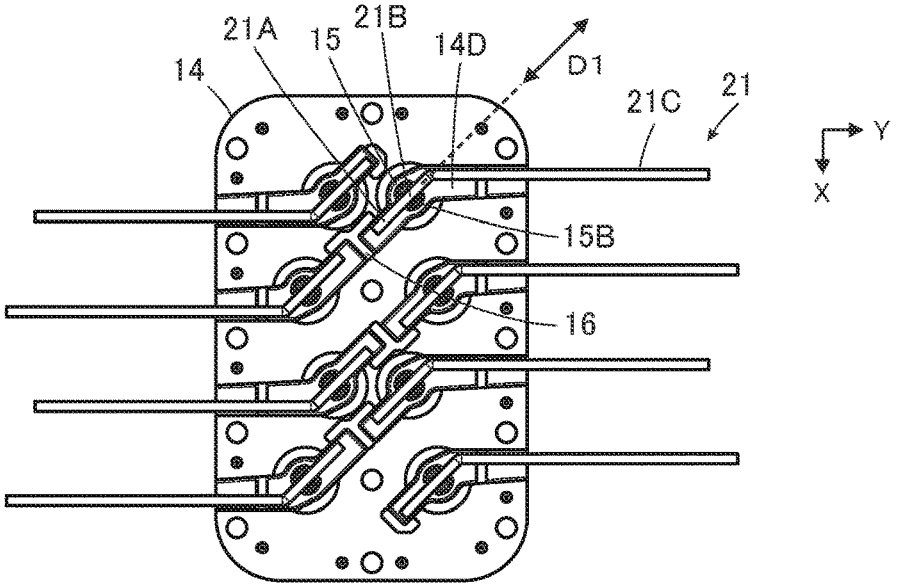
FIG. 6 is a plan view showing a plurality of projections of the base member with a plurality of flexible conductors being separately disposed thereon.

For connecting the connector 11 to the plurality of flexible conductors 21, as illustrated in FIG. 6, middle parts 21B of the flexible conductors 21 are inserted into the holding grooves 15B of the corresponding projections 15 of the base member 14, whereby the flexible conductors 21 are held by the holding grooves 15B of the projections 15. In this process, since the holding grooves 15B of the projections 15 have a width dimension larger than the diameter dimension of the flexible conductors 21, the flexible conductors 21 can be smoothly inserted into the corresponding holding grooves 15B from the +Z direction side.

Each of the flexible conductors 21 bends between the middle part 21B and a base part 21C such that a tip end part 21A terminating in the inside of the base member 14 and the middle part 21B inserted in the holding groove 15B of the corresponding projection 15 extend in the inclined direction D1 while the base part 21C joined to the middle part 21B and reaching the outside of the base member 14 extends in the Y direction. Accordingly, each flexible conductor 21 extends along the flexible conductor accommodating portions 14D disposed on opposite sides of the corresponding projection 15.

Figure 7:
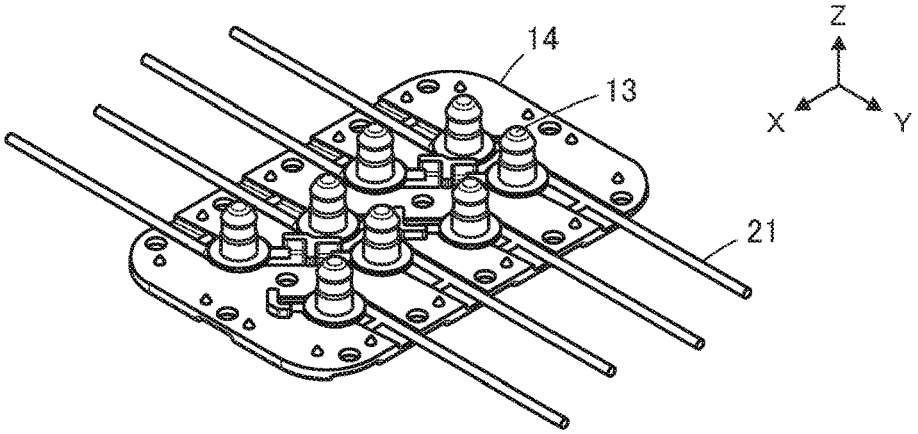
FIG. 7 is a perspective view showing the plurality of projections of the base member with contacts being fitted therewith in a one-by-one manner.

In this state, the contacts 13 are fitted with the projections 15 of the base member 14 as illustrated in FIG. 7. At this time, as illustrated in FIG. 2, the tubular portions 13A of the contacts 13 are separately inserted into the contact through-holes 12B of the housing 12 from the −Z direction side, and the base member 14 shown in FIG. 6 is moved from the −Z direction side toward the +Z direction side to be pressed against the housing 12, whereby the plurality of contacts 13 can be fitted with the plurality of projections 15 in a single step.

Meanwhile, the housing 12 is placed on a surface of, for instance, a workbench (not shown), with the rear surface 12C facing upward as if the drawing of FIG. 2 is vertically reversed to have the +Z direction facing downward and the −Z direction facing upward, the tubular portions 13A of the contacts 13 are inserted into the contact through-holes 12B of the housing 12 from above, and in this state, the base member 14 as illustrated in FIG. 6 is turned upside down and pressed against the housing 12 from above, whereby the connection process for connecting the connector 11 to the plurality of flexible conductors 21 becomes easier.

In addition, by pressing the base member 14 against the housing 12, the plurality of bosses 12D of the housing 12 are press-fitted into the plurality of boss accommodating holes 14C of the base member 14 to fix the housing 12 and the base member 14 to each other, and the connection process for connecting the connector 11 to the plurality of flexible conductors 12 is completed.

Figure 8:
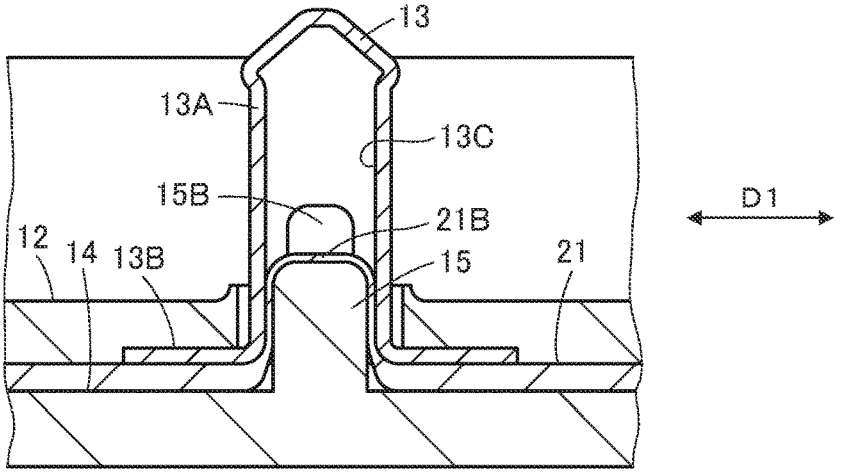
FIG. 8 is a cross-sectional side view showing the contact, the projection and the flexible conductor in the connector according to Embodiment 1.

When the projections 15 of the base member 14 are separately fitted with the contacts 13 as above, each of the projections 15 of the base member 14 is inserted into the projection accommodating portion 13C of a recess shape of the corresponding contact 13 with the flexible conductor 21 being sandwiched therebetween, and parts of the flexible conductor 21 that are situated on opposite sides of and are adjoining the middle part 21B of the flexible conductor 21 are sandwiched between a lateral surface of the projection 15 and an inner surface of the projection accommodating portion 13C of the contact 13 as illustrated in FIG. 8. Accordingly, the flexible conductor 21 contacts the inner surface of the projection accommodating portion 13C, whereby the contact 13 is electrically connected to the flexible conductor 21.

FIG. 8 illustrates a cross-sectional side view taken along the inclined direction D1.

In this Embodiment 1, since each flexible conductor 21 is inserted in and held by the holding groove 15B formed at the tip of the corresponding projection 15 of the base member 14, and in this state, the projection 15 together with the flexible conductor 21 is inserted into the projection accommodating portion 13C of a recess shape of the contact 13, the relative position between the projection 15 and the flexible conductor 21 would not shift even when the flexible conductor 21 has a narrower width than the width of the projection 15, making it possible to readily connect the connector 11 to the flexible conductors 21.

In addition, even when the flexible conductor 21 is made of a sheet-like or a band-like conductor having a width wider than the width of the projection 15, as long as the flexible conductor 21 can be, for example, folded and inserted into the holding groove 15B of the projection 15, the connector 11 can be readily connected to the flexible conductors 21 while a shift in positional relationship between each projection 15 and the corresponding flexible conductor 21 is prevented. As a result, the reliability of electrical connection of the connector 11 to the flexible conductors 21 can be assured.

The projection 15 as illustrated in FIG. 3 includes a protruding part formed on the −Z direction side on a lateral surface of the projection body 15A and laterally protruding from the projection body 15A. The protruding part is used to press the projection 15 into the projection accommodating portion 13C of the contact 13 and is not essential. The projection 15 does not have to include the protruding part that laterally protrudes from the projection body 15A as long as the flexible conductor 21 can be sandwiched between the lateral surface of the projection 15 and the inner surface of the projection accommodating portion 13C of the contact 13 and can contact the inner surface of the projection accommodating portion 13C when the projection 15 together with the flexible conductor 21 held by the holding groove 15B is inserted into the projection accommodating portion 13C of the contact 13.

As illustrated in FIG. 6, among the plurality of projections 15 of the base member 14, two projections 15 in each pair are aligned in the Y direction, while the flexible conductor accommodating grooves 14D disposed on opposite sides of each projection 15 separately extend in directions intersecting each other, and two flexible conductor accommodating grooves 14D disposed between the paired two projections 15 extend in the inclined direction D1. Therefore, two flexible conductors 21 held by the holding grooves 15B of the paired two projections 15 aligned in the Y direction can be prevented from contacting each other to short-circuit.

Moreover, between two projections 15 aligned in the inclined direction D1 among the plurality of projections 15, two corresponding flexible conductor accommodating grooves 14D are situated on a single line along the inclined direction D1, and the partition wall 16 is formed between the two flexible conductor accommodating grooves 14D. Therefore, two flexible conductors 21 accommodated in the two flexible conductor accommodating grooves 14D situated on the single line along the inclined direction D1 can be prevented from contacting each other to short-circuit.

Embodiment 2

While in Embodiment 1, the base member 14 having the plurality of projections 15 is used as a pushing member for pushing the projections 15 into the projection accommodating portions 13C of the contacts 13, the invention is not limited thereto.

Figure 9:
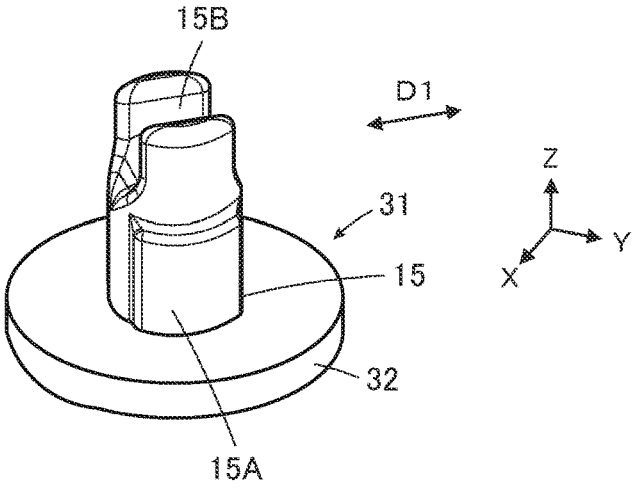
FIG. 9 is a perspective view showing a pushing member used in a connector according to Embodiment 2.

FIG. 9 shows a pushing member 31 used in a connector according to Embodiment 2. In the pushing member 31, a pushing member-side flange 32 is integrally formed at a root portion of a single projection 15.

The flexible conductor 21 is inserted into and held by the holding groove 15B of the projection 15 of the pushing member 31 configured as above, and the projection 15 of the pushing member 31 together with the flexible conductor 21 is inserted into the projection accommodating portion 13C of the corresponding contact 13, whereby the contact 13 can be electrically connected to the flexible conductor 21.

Figure 10:
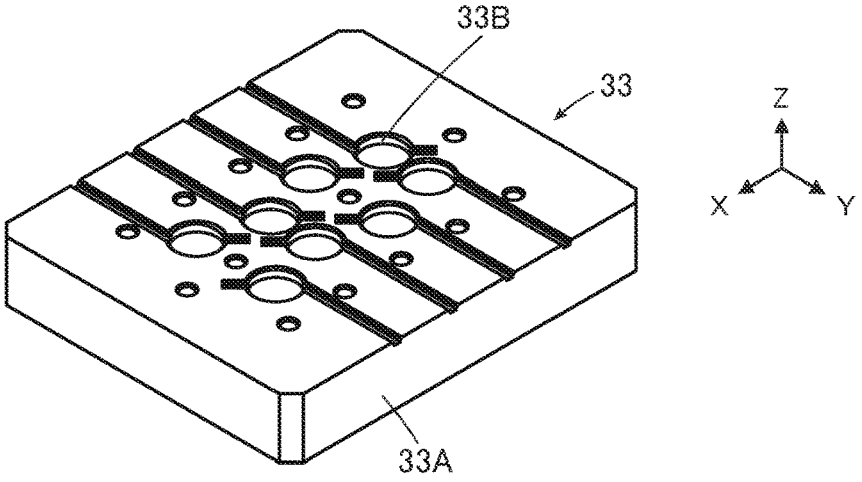
FIG. 10 is a perspective view showing a pushing jig used for assembling the connector according to Embodiment 2.

While the pushing member 31 as illustrated in FIG. 9 is used to insert a single projection 15 into the projection accommodating portion 13C of a single contact 13, when a pushing jig 33 as illustrated in FIG. 10 is used for example, the plurality of projections 15 can be inserted into the projection accommodating portions 13C of the plurality of contacts 13 at a time, as with the base member 14 in Embodiment 1.

In FIG. 10, the pushing jig 33 includes a jig body 33A of a flat plate shape and a plurality of pushing member-side flange fitting portions 33B formed on a front surface of the jig body 33A. Each pushing member-side flange fitting portion 33B has a substantially same size as that of the pushing member-side flange 32 of the pushing member 31, allowing the pushing member-side flange 32 to be readily fitted into the corresponding pushing member-side flange fitting portion 33B to temporarily fix the pushing member 31 to the pushing jig 33. In addition, by pulling the pushing member 31 that is temporarily fixed to the pushing jig 33 out, the pushing member 31 can be readily detached from the pushing jig 33.

Figure 11:
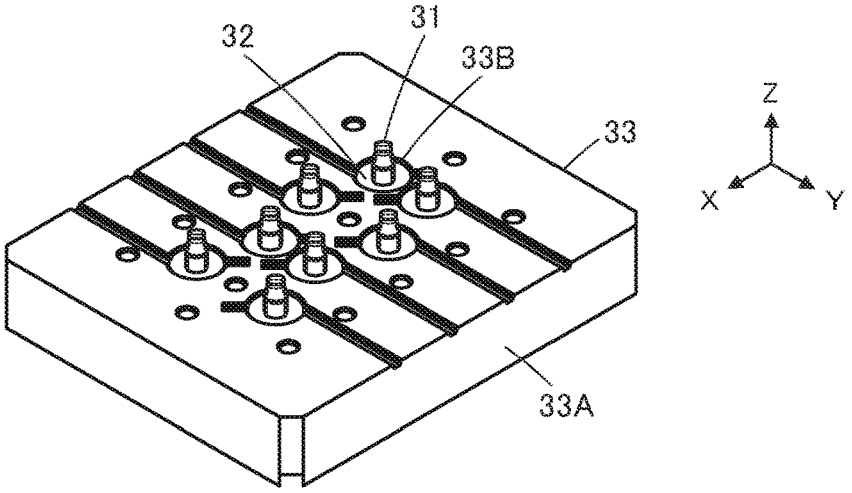
FIG. 11 is a perspective view showing the pushing jig with a plurality of pushing members being held thereby in Embodiment 2.

For connecting the connector according to Embodiment 2 to the plurality of flexible conductors 21, first, as illustrated in FIG. 11, the pushing member-side flanges 32 of the pushing members 31 are separately fitted into the pushing member-side flange fitting portions 33B of the pushing jig 33 to thereby temporarily fix the pushing members 31 to the pushing jig 33.

Next, the flexible conductor 21 is inserted into the holding groove 15B of the projection 15 of each of the pushing members 31, whereby the plurality of flexible conductors 21 are held by the holding grooves 15B of the plurality of projections 15.

Figure 12:
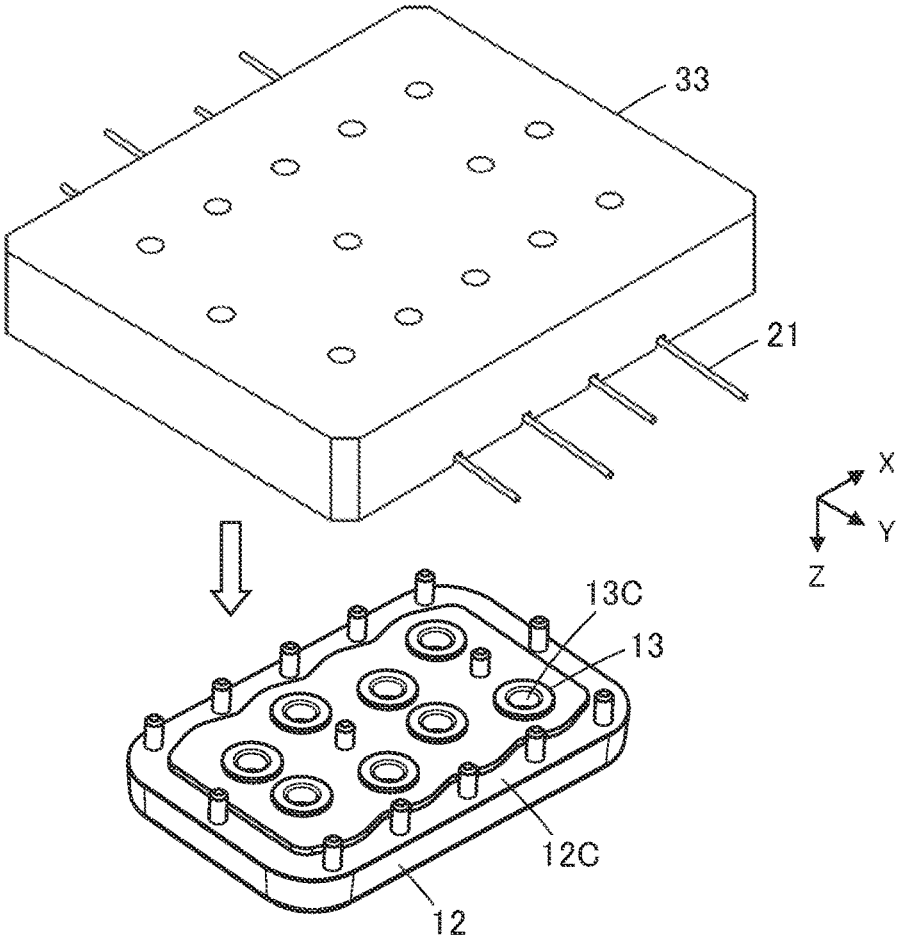
FIG. 12 is a perspective view showing the pushing jig by which the plurality of pushing members and a plurality of flexible conductors are held, the pushing jig being pushed toward a housing which holds a plurality of contacts in Embodiment 2.

In addition, as illustrated in FIG. 12, the housing 12 is placed on a surface of, for instance, a workbench (not shown) with the rear surface 12C facing upward, the tubular portions 13A of the contacts 13 are separately inserted into the contact through-holes 12B of the housing 12 from above, and in this state, the pushing jig 33 is pressed against the housing 12 from above with the projections 15 facing and projecting downward. In this manner, together with the plurality of flexible conductors 21, the projections 15 of the plurality of pushing members 31 that are temporarily fixed to the pushing jig 33 are inserted into the projection accommodating portions 13 of the plurality of contacts 13 at a time, and each of the contacts 13 is electrically connected to the corresponding flexible conductor 21.

Figure 13:
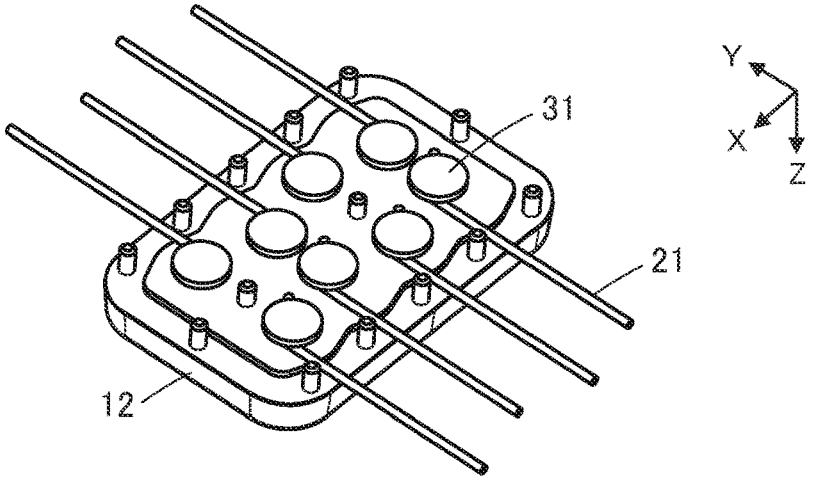
FIG. 13 is a perspective view showing the plurality of pushing members and the plurality of flexible conductors attached to the housing in Embodiment 2.

Thereafter, by detaching the pushing jig 33 from the pushing members 31, the connector according to Embodiment 2, in which the pushing members 31 and the flexible conductors 21 are attached to the housing 12 as illustrated in FIG. 13, is produced.

Figure 14:
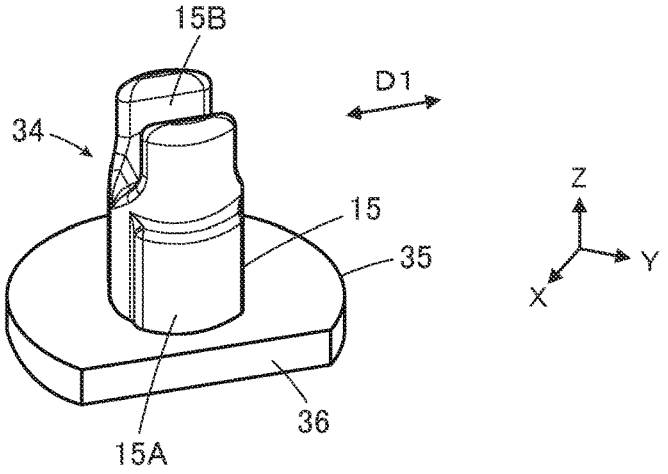
FIG. 14 is a perspective view showing a pushing member used in a connector according to a variation of Embodiment 2.

In place of the pushing member 31, a pushing member 34 as illustrated in FIG. 14 may be used. In the pushing member 34, a pushing member-side flange 35 is integrally formed at the root portion of the projection body 15A of a single projection 15, and a key portion 36 is formed in the pushing member-side flange 35. The key portion 36 is a planar portion formed by cutting part of the pushing member-side flange 35 out and has directionality corresponding to the inclined direction D1 along which the holding groove 15B of the projection 15 extends. More specifically, the key portion 36 has a plane extending along the inclined direction D1.

Figure 15:
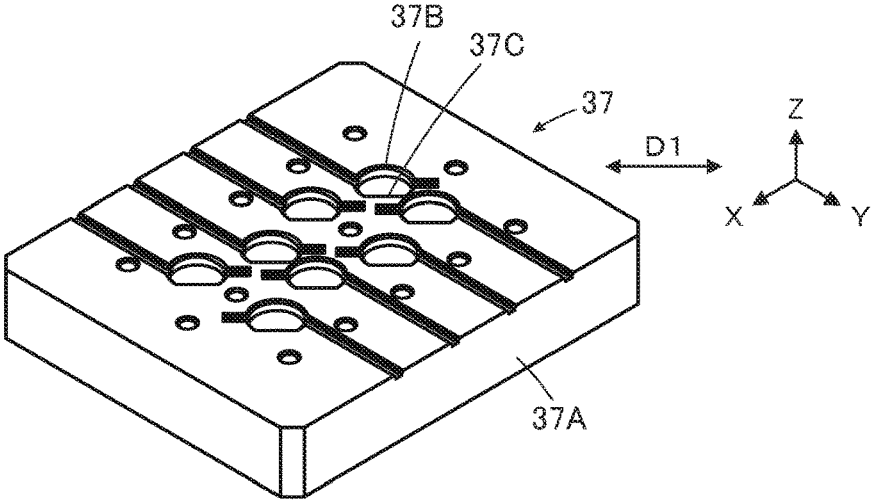
FIG. 15 is a perspective view showing a pushing jig used for assembling the connector according to the variation of Embodiment 2.

The pushing member 34 having the key portion 36 configured as above is used with, for example, a pushing jig 37 as illustrated in FIG. 15. The pushing jig 37 includes a jig body 37A of a flat plate shape and a plurality of pushing member-side flange fitting portions 37B formed on a front surface of the jig body 37A, and each of the pushing member-side flange fitting portions 37B is provided with a key reception portion 37C. The key reception portion 37C has a plane corresponding to the key portion 36 of the pushing member 34, and the key reception portions 37C of the plurality of pushing member-side flange fitting portions 37B face in a same direction.

The pushing member-side flange fitting portion 37B has a substantially same size as that of the pushing member-side flange 35 of the pushing member 34. Owing to the key portion 36 and the key reception portion 37C, when the pushing member-side flange 35 is fitted into the pushing member-side flange fitting portion 37B, the pushing member 34 is temporarily fixed and an orientation thereof can be regulated.

Hence, when the pushing members 34 are temporarily fixed to the pushing member-side flange fitting portions 37B of the pushing jig 37 in a one-by-one manner, the holding grooves 15B of the projections 15 of the plurality of pushing members 34 extend in the same direction, i.e., the inclined direction D1. Accordingly, even with use of the independent pushing members 34, the direction in which the middle parts 21B of the flexible conductors 21 extend and the direction in which the holding grooves 15B of the projections 15 extend can be readily aligned, allowing the connector to be connected to the plurality of flexible conductors 21.

Embodiment 3

Figure 16:
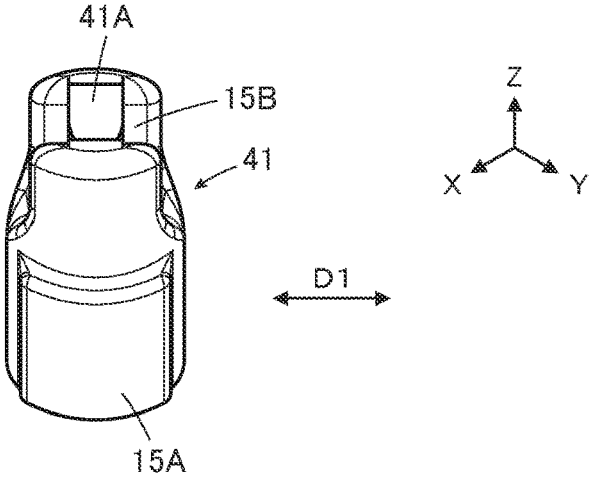
FIG. 16 is a perspective view showing a projection used in a connector according to Embodiment 3.
Figure 17:
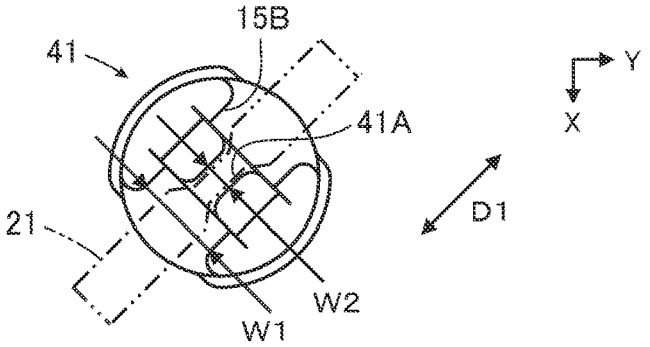
FIG. 17 is a plan view showing the projection used in the connector according to Embodiment 3.

In place of the projection 15 of Embodiments 1 and 2, a projection 41 as illustrated in FIGS. 16 and 17 may be used. The projection 41 is configured to include a narrow portion 41A on the inside of the holding groove 15B of the projection 15 used in Embodiments 1 and 2. The narrow portion 41A has a width W2 narrower than a width W1 of the holding groove 15B at opposite ends in the inclined direction D1 of the holding groove 15B.

Hence, when the flexible conductor 21 is inserted into the holding groove 15B of the projection 41, part of the flexible conductor 21 is compressed in a direction orthogonal to the inclined direction D1 at the narrow portion 41A and engaged in the holding groove 15B, whereby the position of the flexible conductor 21 relative to the holding groove 15B is fixed. Accordingly, each flexible conductor 21 is prevented from falling off the holding groove 15B of the corresponding projection 41 during the connection process for connecting the connector to the flexible conductors 21, whereby the connection process can be more efficiently preformed.

Figure 18:
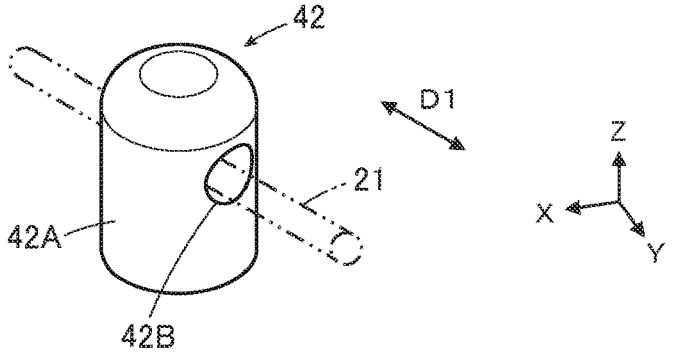
FIG. 18 is a perspective view showing a projection used in a connector according to a variation of Embodiment 3.

In addition, a projection 42 as illustrated in FIG. 18 may also be used. The projection 42 includes a projection body 42A in the shape of a substantially cylindrical column extending in the +Z direction, and the projection body 42A is provided with a holding hole 42B penetrating across the projection body 42A in the inclined direction D1.

The holding hole 42B forms a holding portion for holding the middle part of the flexible conductor 21 made of a conductive yarn, and the flexible conductor 21 is passed through the holding hole 42B to be held by the holding hole 42B.

Even with use of the foregoing projection 42, a shift in positional relationship between the projection 42 and the flexible conductor 21 can be prevented while the connector can be readily connected to the flexible conductors 21.

Figure 19:
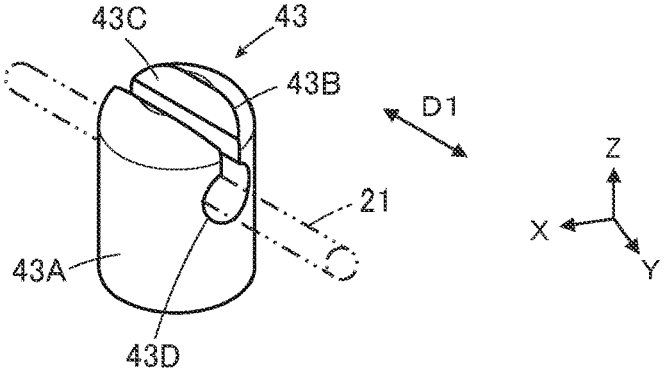
FIG. 19 is a perspective view showing a projection used in a connector according to another variation of Embodiment 3.

Further, a projection 43 as illustrated in FIG. 19 may also be used. The projection 43 includes a projection body 43A in the shape of a substantially cylindrical column extending in the +Z direction, and the projection body 43A is provided at the +Z directional end thereof with a holding groove 43B. The holding groove 43B opens in the +Z direction, i.e., the projecting direction of the projection 43, and extends across the projection 43 in the inclined direction D1. In the holding groove 43B, an enlarged portion 43D having a width wider than a width of the holding groove 43B at an opening end portion 43C on the +Z direction side is formed and extends in the inclined direction D1.

The holding groove 43B forms a holding portion for holding the middle part of the flexible conductor 21 made of a conductive yarn, and, in particular, when the width of the flexible conductor 21 is wider than the width of the holding groove 43B, the flexible conductor 21 is inserted from the opening end portion 43C of the holding groove 43B in the −Z direction and is held in the enlarged portion 43D.

The flexible conductor 21 having been inserted and reached the enlarged portion 43D is prevented from falling off the holding groove 43B in the +Z direction, owing to the opening end portion 43C formed on the +Z direction side of the enlarged portion 43D and having the narrower width than the width of the enlarged portion 43D. Accordingly, a shift in positional relationship between each projection 43 and the corresponding flexible conductor 21 can be prevented, and the connector can be readily connected to the flexible conductors 21.

The flexible conductor 21 is not limited to that made of a conductive yarn but may be made of a sheet-like or band-like conductor also for use with the projection 41 as illustrated in FIGS. 16 and 17, the projection 42 as illustrated in FIG. 18 and the projection 43 as illustrated in FIG. 19. Even when a sheet-like or band-like conductor is used, as long as the flexible conductor 21 can be, for example, folded and held by the holding groove 15B of the projection 41, the holding hole 42B of the projection 42 or the holding groove 43B of the projection 43, a shift in a positional relationship between each projection 41, 42, 43 and the flexible conductor 21 can be prevented, and the connector can be readily connected to the flexible conductors 21.

Figure 20:
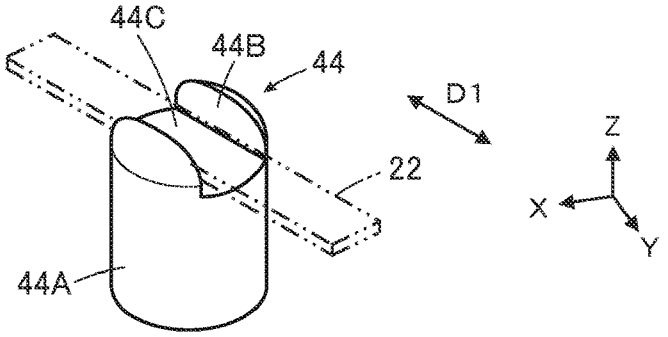
FIG. 20 is a perspective view showing a projection used in a connector according to yet another variation of Embodiment 3.

Moreover, a projection 44 as illustrated in FIG. 20 may also be used. The projection 44 includes a projection body 44A in the shape of a substantially cylindrical column extending in the +Z direction, and the projection body 44A is provided at the +Z directional end thereof with a holding groove 44B opening in the +Z direction and extending across the projection 44 in the inclined direction D1. The holding groove 44B has a bottom surface 44C of a planar shape.

Since the bottom surface 44C of the holding groove 44B has a planar shape, the projection 44 is particularly effective when the connector is connected to flexible conductors 22 of a band-like shape. With use of the projection 44 thus configured, a shift in a positional relationship between the projection 44 and the flexible conductor 22 can be prevented, and the connector can be readily connected to the flexible conductors 22.

Embodiment 4

Figure 21:
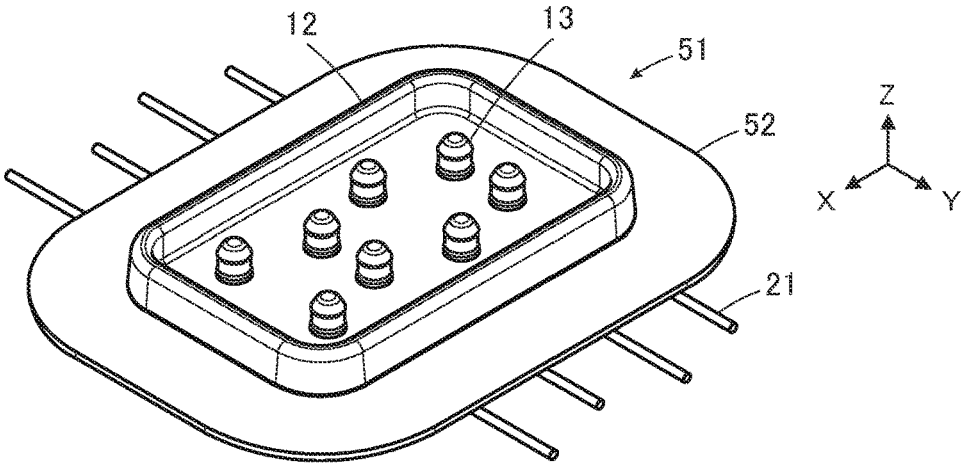
FIG. 21 is a perspective view showing a connector according to Embodiment 4.

FIG. 21 illustrates a connector 51 according to Embodiment 4. The connector 51 is the same as the connector 11 according to Embodiment 1 except that a connector fixing member 52 of a sheet shape is disposed between the housing 12 and the base member 14 of the connector 11 according to Embodiment 1 illustrated in FIG. 1.

The connector fixing member 52 is made of insulating resin or cloth and extends to the outside of the housing 12 so as to seamlessly surround the outer periphery of the housing 12.

Figure 22:
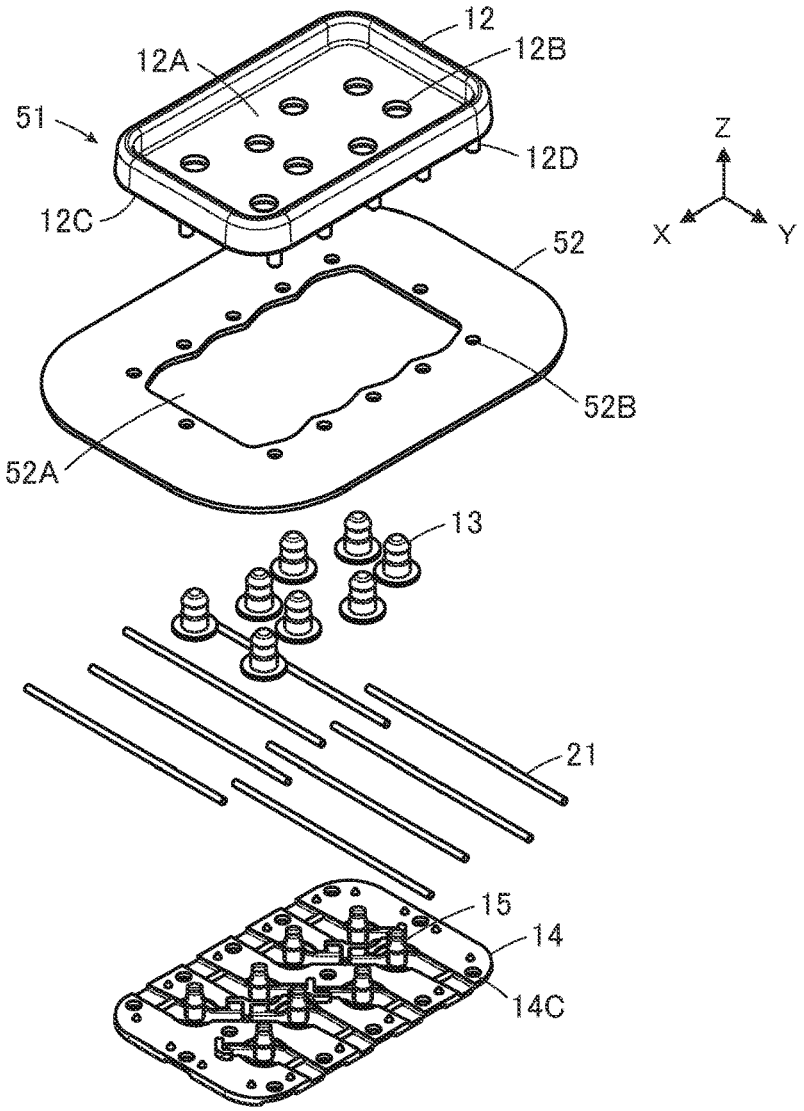
FIG. 22 is an exploded perspective view of the connector according to Embodiment 4.

As illustrated in FIG. 22, the connector fixing member 52 is provided at the center thereof with an opening portion 52A, and a plurality of through-holes 52B are arranged along the periphery of the opening portion 52A.

The opening portion 52A has a size that can accommodate the plurality of contact through-holes 12B of the housing 12 and the plurality of projections 15 of the base member 14 but cannot accommodate the plurality of bosses 12D of the housing 12. The through-holes 52B separately correspond to the bosses 12D of the housing 12.

By relatively pressing the base member 14 against the housing 12 with the connector fixing member 52 being sandwiched between the housing 12 and the base member 14, the bosses 12D of the housing 12 are separately pressed into the boss accommodating holes 14C of the base member 14 via the through holes 52B of the connector fixing member 52, whereby the housing 12 and the base member 14 are fixed to each other while the connector fixing member 52 is fixed between the housing 12 and the base member 14.

Figure 23:
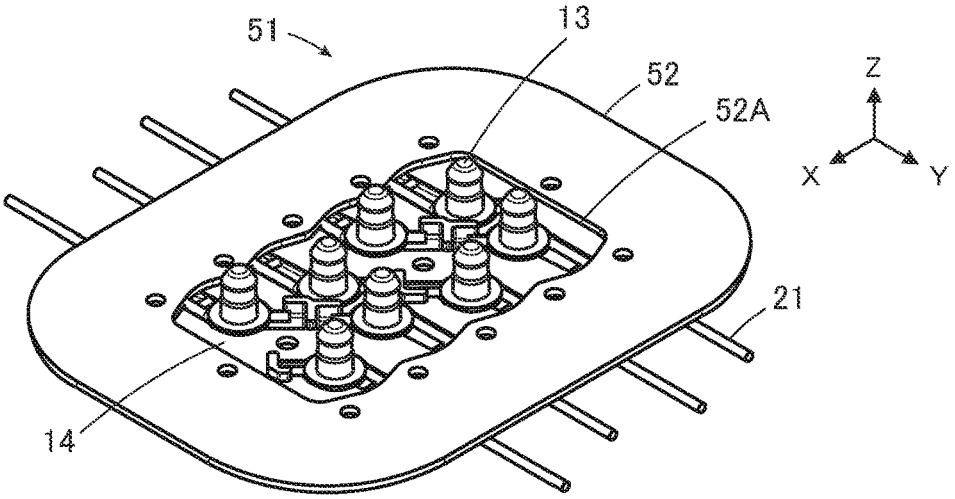
FIG. 23 is a perspective view showing the connector according to Embodiment 4 with a housing being omitted.

At this time, as illustrated in FIG. 23, the contacts 13 are situated within the opening portion 52A of the connector fixing member 52. It should be noted that FIG. 23 shows the internal structure of the connector 51 with the housing 12 being omitted.

The connector 51 can be attached to a garment by sewing the circumferential edge of the connector fixing member 52 on the outside of the housing 12 to cloth of the garment using, for example, an insulating thread.

Embodiment 5

Figure 24:
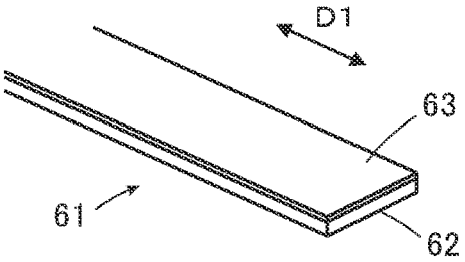
FIG. 24 is a perspective view showing a flexible conductor to which a connector according to Embodiment 5 is connected.
Figure 25:
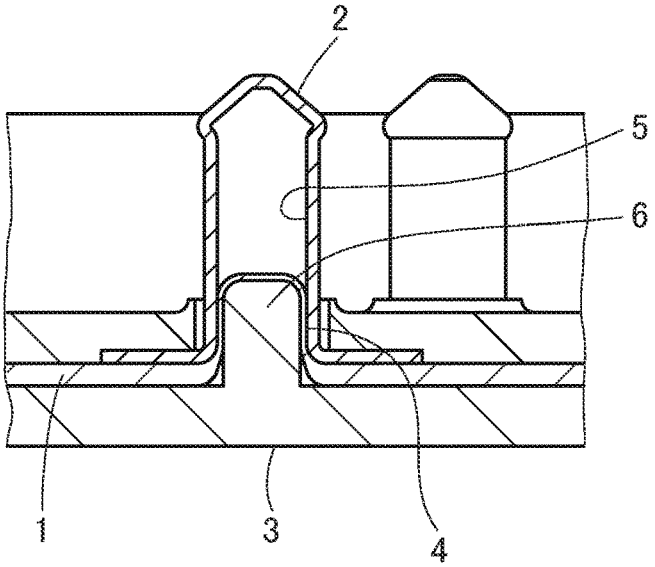
FIG. 25 PRIOR ART
FIG. 25 is a cross-sectional view showing a contact, a projection and a flexible substrate in a conventional connector.

In Embodiments 1 to 4, the flexible conductor 21, 22 is not supported by, for example, an insulating substrate body but is independently disposed between the projection 15, 41, 42, 43, 44 and the contact 13. However, the invention is not limited thereto. The connector according to the invention can be connected to a flexible substrate 61 as illustrated in FIG. 24.

The flexible substrate 61 has a flexible conductor 63 disposed to be exposed on a top surface of a sheet-like substrate body 62 made of an insulating material.

For connecting the connector to the foregoing flexible substrate 61, the flexible substrate 61 is disposed such that the flexible conductor 63 faces the inner surface of the projection accommodating portion 13C of the contact 13 while a bottom surface of the substrate body 62 faces the lateral surface of the projection 15, 41, 42, 43, 44. In this manner, the contact 13 can be electrically connected to the flexible conductor 63 as with Embodiments 1 to 4.

While the plug-type contacts 13 are used in the above-described Embodiments 1 to 5, the invention is not limited thereto, and it is also possible to similarly configure a connector in which a receptacle-type contact is connected to the flexible conductors 21, 22, 63.

What is claimed is:

1. A connector to be connected to a flexible conductor, the connector comprising:

a pushing member having a projection; and a contact made of a conductive material and having a tubular portion and a projection accommodating portion of a recess shape formed in the tubular portion into which the projection is inserted, wherein the projection includes a holding portion extending across the projection in a direction orthogonal to a projecting direction of the projection and holding the flexible conductor, and wherein, when the projection is inserted into the projection accommodating portion of the contact together with the flexible conductor with a middle part of the flexible conductor being held by the holding portion of the projection, parts of the flexible conductor that are situated on opposite sides of and are adjoining the middle part of the flexible conductor are sandwiched between a lateral surface of the projection and an inner surface of the projection accommodating portion to contact the inner surface of the projection accommodating portion, whereby the contact is electrically connected to the flexible conductor.

2. The connector according to claim 1, wherein the holding portion comprises a holding groove opening at a tip of the projection in the projecting direction and extending across the projection.

3. The connector according to claim 2, wherein the holding portion includes a narrow portion in the holding groove, the narrow portion having a width narrower than a width of the holding groove at opposite ends of the holding groove in a direction in which the holding groove extends.

4. The connector according to claim 2, wherein the holding portion includes an enlarged portion in the holding groove, the enlarged portion having a width wider than a width of the holding groove at an opening end of the holding groove opening in the projecting direction.

5. The connector according to claim 1, wherein the holding portion comprises a holding hole penetrating across the projection.

6. The connector according to claim 1, wherein the pushing member comprises a base member including a flat plate portion and a plurality of the projections formed to project on the flat plate portion, and wherein the plurality of the projections are separately inserted into the projection accommodating portions of a plurality of the contacts with a plurality of the flexible conductors being sandwiched therebetween.

7. The connector according to claim 6, wherein the holding portions of the plurality of the projections extend in a same direction.

8. The connector according to claim 6, wherein the flat plate portion includes a plurality of pairs of flexible conductor accommodating grooves, each of the pairs of the flexible conductor accommodating grooves being separately disposed on opposite sides across a corresponding one of the projections and accommodating a corresponding one of the flexible conductors.

9. The connector according to claim 8, wherein the pair of the flexible conductor accommodating grooves separately disposed on opposite sides of each of the projections separately extend in directions intersecting each other.

10. The connector according to claim 6, wherein the contact has a contact-side flange formed at one end of the tubular portion, wherein the connector further includes a housing having a contact through-hole through which the tubular portion of the contact passes and which is smaller than the contact-side flange, and wherein, when the housing is fixed to the base member such that the tubular portion of the contact passes through the contact through-hole and the contact-side flange is pressed against the base member, the contact is fixed to the base member.

11. The connector according to claim 10, wherein the housing has a plurality of bosses projecting toward the base member, wherein the base member has a plurality of boss accommodating holes for accommodating the plurality of bosses, and wherein the plurality of bosses are accommodated in the plurality of boss accommodating portions to fix the housing to the base member.

12. The connector according to claim 10, wherein the housing is made of an insulating material.

13. The connector according to claim 10, wherein the housing has a counter connector accommodating portion for accommodating a part of a counter connector.

14. The connector according to claim 6, wherein the base member is made of an insulating material.

15. The connector according to claim 6, further comprising a connector fixing member of a sheet shape held by the base member and extending to an outside of the base member.

16. The connector according to claim 1, wherein the pushing member has a pushing member-side flange joined to a root portion of the projection.

17. The connector according to claim 16, wherein the pushing member-side flange includes a key portion having directionality corresponding to a direction in which the holding portion of the projection extends.

18. The connector according to claim 1, wherein the flexible conductor is independently disposed on the pushing member.

19. The connector according to claim 1, wherein the flexible conductor is disposed to be exposed on a top surface of an insulating substrate body, and wherein the flexible conductor is disposed on the pushing member such that the flexible conductor faces the inner surface of the projection accommodating portion while a bottom surface of the substrate body faces the lateral surface of the projection.

20. The connector according to claim 1, wherein the contact is a plug-type contact.

21. A connecting method for connecting a contact to a flexible conductor, the contact having a tubular portion and a projection accommodating portion of a recess shape formed in the tubular portion, the method comprising:

holding a middle part of the flexible conductor by a holding portion extending across a projection of a pushing member in a direction orthogonal to a projecting direction of the projection; and inserting the projection into the projection accommodating portion of a recess shape of the contact together with the flexible conductor, whereby parts of the flexible conductor that are situated on opposite sides of and are adjoining the middle part of the flexible conductor are sandwiched between a lateral surface of the projection and an inner surface of the projection accommodating portion to contact the inner surface of the projection accommodating portion, whereby the contact is electrically connected to the flexible conductor.

22. The connecting method according to claim 21, the method further comprising:

temporarily fixing a plurality of the pushing members to a pushing jig of a flat plate shape;

holding the middle parts of a plurality of the flexible conductors separately by the holding portions of the projections of the plurality of the pushing members;

pressing the pushing jig against a housing, by which a plurality of the contacts are held, to insert each of the projections of the pushing members into the projection accommodating portion of a corresponding one of the contacts together with a corresponding one of the flexible conductors; and detaching the pushing jig from the plurality of the pushing members.

23. The connecting method according to claim 22, wherein the pushing members have pushing member-side flanges each of which is joined to a root portion of a corresponding one of the projections and has a key portion having directionality corresponding to a direction in which the holding portion of the corresponding one of the projections extends, wherein the pushing jig has pushing member-side flange fitting portions into which the pushing member-side flanges are fitted, each of the pushing member-side flange fitting portions having a key reception portion corresponding to the key portion, and wherein the pushing member-side flanges are fitted into the pushing member-side flange fitting portions to temporarily fix the pushing members to the pushing jig.

* * * * *